US009574283B2

(12) United States Patent
Arvin et al.

(10) Patent No.: US 9,574,283 B2
(45) Date of Patent: Feb. 21, 2017

(54) RINSING AND DRYING FOR ELECTROCHEMICAL PROCESSING

(71) Applicant: International Business Machines Corporation, Armonk, NY (US)

(72) Inventors: Charles L. Arvin, Poughkeepsie, NY (US); Raschid J. Bezama, Mahopac, NY (US); Hariklia Deligianni, Tenafly, NJ (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/948,259

(22) Filed: Nov. 21, 2015

(65) Prior Publication Data

US 2016/0076167 A1 Mar. 17, 2016

Related U.S. Application Data

(62) Division of application No. 12/806,730, filed on Aug. 19, 2010, now Pat. No. 9,222,194.

(51) Int. Cl.
*C25F 3/02* (2006.01)
*C25D 17/00* (2006.01)
(Continued)

(52) U.S. Cl.
CPC ..... *C25D 17/00* (2013.01); *C25D 5/48* (2013.01); *C25D 21/08* (2013.01); *C25F 3/02* (2013.01); *C25F 3/12* (2013.01); *C25F 7/00* (2013.01)

(58) Field of Classification Search
CPC ..... C25F 3/02
See application file for complete search history.

(56) References Cited

U.S. PATENT DOCUMENTS 3,658,470 A 4/1972 Zievers et al.
3,935,041 A 1/1976 Goffredo et al.
(Continued)

FOREIGN PATENT DOCUMENTS

JP H06-192865 A 7/1994
WO 2008/148580 A2 12/2008
WO WO 2008148580 A2 * 12/2008 ..... C25D 17/06

OTHER PUBLICATIONS

Liu et al., "A High-Yield Drying Process for Surface-Micromachined Structures Using Magnetostatic Forces", Sensors and Materials, 1999, vol. 11, No. 2, pp. 71-86.
(Continued)

*Primary Examiner* — Bryan D. Ripa
(74) *Attorney, Agent, or Firm* — Scully, Scott, Murphy & Presser, P.C.; Vazken Alexanian

(57) ABSTRACT

An electroplating/etch apparatus including a fluid jet and a dryer present over the tank containing the electrolyte for the electroplating/etch process. The fluid jet and the dryer remove excess liquids, such as electrolyte, from the component being plated or etched, e.g., working electrode. The working electrode is present on a holder that traverses from a first position within the tank during a plating or etch operation to a second position that is outside the containing the plating electrolyte. The fluid jet rinses the working electrode when the holder is in the second position, and the forced air dryer blows any remaining fluid from the fluid jet and the electrolyte from the working electrode into the tank.

15 Claims, 1 Drawing Sheet

(51) Int. Cl.

| | |
|---|---|
| ***C25D 5/48*** | (2006.01) |
| ***C25D 21/08*** | (2006.01) |
| ***C25F 3/12*** | (2006.01) |
| ***C25F 7/00*** | (2006.01) |

(56) References Cited

U.S. PATENT DOCUMENTS

| | | | | |
|---|---|---|---|---|
| 5,544,869 | A | 8/1996 | Chifo | |
| 5,660,642 | A | 8/1997 | Britten | |
| 5,762,749 | A | 6/1998 | Suzuki et al. | |
| 6,214,193 | B1 | 4/2001 | Reid et al. | |
| 6,398,904 | B1 | 6/2002 | Heo et al. | |
| 6,471,848 | B1 | 10/2002 | Arao et al. | |
| 6,881,319 | B2 | 4/2005 | Seita et al. | |
| 7,252,098 | B2 * | 8/2007 | Fishkin ..... | H01L 21/67028 134/184 |
| 7,616,383 | B2 | 11/2009 | Streefkerk et al. | |
| 2004/0241996 | A1 | 12/2004 | Hung et al. | |
| 2006/0049062 | A1 | 3/2006 | Orosz et al. | |
| 2006/0118132 | A1 | 6/2006 | Bergman et al. | |
| 2007/0042110 | A9 | 2/2007 | Benson et al. | |
| 2009/0044839 | A1 * | 2/2009 | Stein ..... | H01L 21/67034 134/95.2 |
| 2009/0115979 | A1 | 5/2009 | Van Der Heijden et al. | |
| 2009/0121156 | A1 | 5/2009 | Mahoney et al. | |

OTHER PUBLICATIONS

Lo et al., "Economic Analysis of Waste Minimization for Electroplating plants", Water Science and Technology, vol. 36, No. 2-3, 1997, pp. 383-390.

* cited by examiner

RINSING AND DRYING FOR ELECTROCHEMICAL PROCESSING

BACKGROUND

The present disclosure relates generally to electroplating and etch methods. More particularly, and in some embodiments, the present disclosure relates to methods for rinsing working electrode during an electrochemical process, such as electroplating and etching.

Microelectronic devices, such as semiconductor devices, imagers, displays, storage media, and micromechanical components, are generally fabricated on and/or in microfeature wafers using a number of processes that deposit and/or remove materials from the wafers. Electroplating is one such process that deposits conductive, magnetic or electrophoretic layers on the wafers. Electroplating processes, for example, are widely used to form small copper interconnects or other very small sub-micron features in trenches and/or holes (e.g., less than 90 nm damascene copper lines). Electropolishing is another process that removes material from a wafer, e.g., working electrode. In both of these processes, an electrical current is passed between the wafer and one or more counter electrodes in a manner that deposits or removes material from a surface of the wafer.

SUMMARY

In one embodiment, an apparatus is provided including a fluid jet and a dryer present over a tank containing an electrolyte for a plating and/or etch process. The fluid jet and the dryer remove excess liquids, such as the electrolyte, from the component being plated, e.g., cathode, or etched, e.g., anode. A working electrode is present on a holder that traverses from a first position within the tank containing the electrolyte during one of a plating or etch operation, to a second position that is outside the tank containing the electrolyte. The fluid jet rinses the working electrode when the holder is in the second position. The dryer which is positioned over the tank, is located between the fluid jet and the tank. While the holder is present in the second position, the dryer blows at least a portion of the fluid from the fluid jet and the electrolyte from the working electrode into the tank, wherein a remaining portion of the fluid including the drag out electrolyte is present on the working electrode in an amount ranging from about 5 ml to about 50 ml.

In another aspect, a method of plating is provided that includes providing a tank of an electrolyte including at least one plating metal. An electrode system is provided including an anode present within the tank of the electrolyte and a cathode that can be traversed from a first position within the tank containing the electrolyte to a second position in which the cathode is removed from the tank. The cathode is traversed into the first position and a bias is applied to the anode and the cathode to plate the cathode with at least one plating metal. The cathode is traversed to the second position, and the cathode is rinsed with a fluid jet to dilute a remaining portion of electrolyte that is present on the cathode. At least a portion of the diluted electrolyte that is present on the cathode is then blown from the cathode by a dryer into the tank, wherein a remaining portion of fluid including drag out electrolyte is present on the cathode in an amount ranging from about 5 ml to about 50 ml.

In another aspect, a method of etching is provided that includes providing a tank of an electrolyte. An electrode system is provided including an cathode present within the tank of the electrolyte and an anode that can be traversed from a first position within the tank containing the electrolyte to a second position in which the anode is removed from the tank. The anode is traversed into the first position and a bias is applied to the cathode and to etch the anode. The anode is traversed to the second position, and the anode is rinsed with a fluid jet to dilute a remaining portion of electrolyte that is present on the anode. At least a portion of the diluted electrolyte that is present on the anode is then blown from the anode by a dryer into the tank, wherein a remaining portion of fluid including drag out electrolyte is present on the anode in an amount ranging from about 5 ml to about 50 ml.

BRIEF DESCRIPTION OF THE SEVERAL VIEWS OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION

Figure 1:
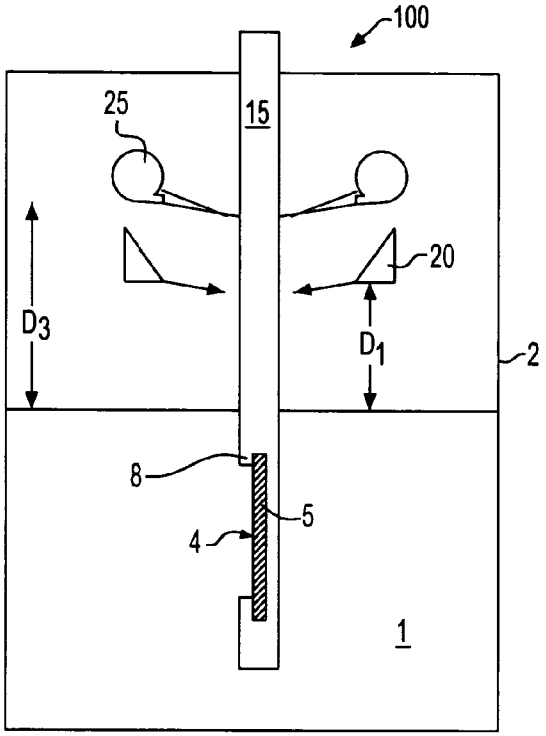
FIG. 1 is a side cross-sectional view depicting a plating/etch apparatus including a fluid jet and a dryer positioned over a tank containing a electrolyte, wherein a working electrode is immersed in the electrolyte for an electroplating or etch process, in accordance with one embodiment of the present disclosure.

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper", "lower", "right", "left", "vertical", "horizontal", "top", "bottom", and derivatives thereof shall relate to the invention, as it is oriented in the drawing figures. The terms "overlying", "atop", "positioned on" or "positioned atop"

mean that a first element, such as a first structure, is present on a second element, such as a second structure, wherein intervening elements, such as an interface structure may be present between the first element and the second element. The term "direct contact" means that a first element, such as a first structure, and a second element, such as a second structure, are connected without any intermediary conducting, insulating or semiconductor layers at the interface of the two elements.

Rinsing steps in electrochemical processing, such as electroplating and etching, can increase process time and cost. Typically, in most electroplating/etching processes, rinsing requires an additional tank as part of a separate process step from the etching and/or electroplating process steps. In some embodiments, the structures and methods disclosed herein reduce process time and cost, by incorporating a fluid jet, in combination with a dryer to rinse the component being plated/etched over the plating/etch tank. In one embodiment, by employing the dryer and gas knife over the tank, bath drag out may be minimized and process time may be decreased. The methods disclosed herein are applicable to electroplating and electroless plating operations. Electroplating is an electrically driven process, whereas electroless plating is a non-electrically driven process.

Figure 2:
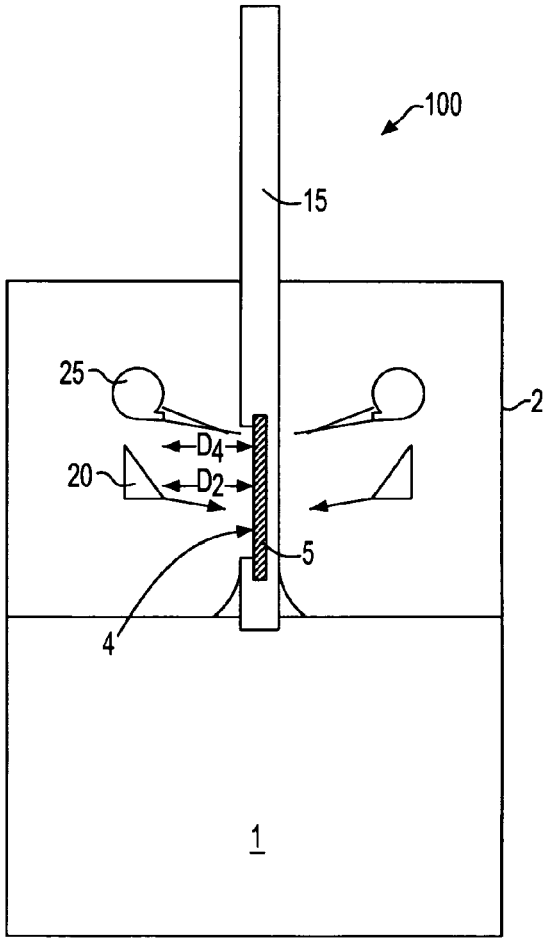
FIG. 2 is a side cross-sectional view depicting a plating/etch apparatus including a fluid jet and a dryer, in which a holder retaining a working electrode has been traversed to remove the working electrode from a tank, wherein once the working electrode is removed from the tank, the working electrode is rinsed with a fluid jet and a dryer, in accordance with one embodiment of the present disclosure.

FIGS. 1 and 2 depict one embodiment of an electroplating/etch apparatus 100 including a fluid jet 20 and a dryer 25 positioned over a tank 2, and a holder 15 for a working electrode 5 that may be traversed from a first position (as depicted in FIG. 1) within the tank 2 containing an electrolyte 1 during a plating/etch operation to a second position (as depicted in FIG. 2) that is outside the tank 2 containing the electrolyte 1. The working electrode 5 is rinsed with the fluid jet 20 and the dryer 25 while the holder 15 is in the second position. It is noted that FIGS. 1 and 2 are only illustrative of the rinsing process disclosed herein, and are not intended to limit the disclosure thereto. For example, the rinsing method disclosed herein is applicable to reel-to-reel plating apparatus. In a reel-to-reel plating system there is a continuous movement of the material to be plated through the electrolyte where it is plated, wherein once plated the material is then moved up out of the solution where it is rinsed. Most of the liquid is knocked back into the tank containing the electrolyte. Further, rinsing tanks may be employed in the continuous flow of the material. The present method may be employed to reel-to-reel plating methods and apparatuses to reduce the number of rinse tanks, and the amount of the electrolyte that is being rinsed into the rinse tanks. The present method may also be employed in plating apparatuses having a horizontal configuration.

The working electrode 5 that is rinsed by the present apparatus and method may be any structure that can be electroplated or etched. In one embodiment, the working electrode 5 has a negative charge, i.e., is connected to the negative terminal of a power supply, and is referred to as a cathode. In this example, positively charged metal ions from the electrolyte 1 are plated on the working electrode 5, i.e., cathode. In another example, the working electrode has a positive charge, i.e., is connected to the positive terminal of a power supply, and is referred to an anode. In this example, the working electrode 5, i.e., anode, is etched by the electrolyte 1.

For example, the working electrode 5 may be composed of any electrically conductive material. As used herein, "conductive" denotes a room temperature conductivity of greater than about $10^{-8}$ $(\Omega\text{-m})^{-1}$. Examples of suitable materials for the working electrode 5 include elemental elements including, but not limited to Cu, Ag, Ni, Fe, Al, Zn, Co, Pd, Ti, platinized Ti, 316 SS, 304 SS, Mo, W, Ru, Rh, Pd, In, Sn, Ta, Ir, Pt, Pb, Bi, Cr, Zr, Nb and combinations and alloys thereof. In one embodiment, the working electrode 5 may be composed of semiconductor materials that may be biased to attract positively charged metal ions from the electrolyte 1 for electroplating. Semiconductor materials may also provide the working electrode 5 for etch operations. The working electrode 5 may have any geometry to be plated/etched. For example, the working electrode 5 may be substantially circular, or it may be multi-sided. The plating/etch surface 4 of the working electrode 5 may be planar or non-planar.

The working electrode 5 is mounted to a holder 15, which supports the working electrode 5 while immersed in the tank 2 that contains the electrolyte 1. The holder 15 may include a lip portion 8 having a surface that extends over and in direct contact with the working electrode 5. The holder 15 is composed of a non-conductive material, i.e., insulating material. As used herein, the term "insulating" means a material having a room temperature conductivity of less than about $10^{-10}$ $(\Omega\text{-m})^{-1}$. Examples of insulating materials that are suitable for the holder include polymeric materials, e.g., plastic or rubber; ceramic materials or glass material. The holder 6 is typically composed of the same material as the tank 2. The holder 15 is configured so that it may be traversed from a first position, in which the working electrode 5 is immersed in the electrolyte 1, as depicted in FIG. 1, to a second position, in which the working electrode 5 is removed from the electrolyte 5. To provide that the holder 15 may be traversed from a first position, as depicted in FIG. 1, to a second position, as depicted in FIG. 2, the holder may include a mechanical armature (not shown). The mechanical armature may be actuated by electrical/mechanical motors, or may be hydraulically actuated, or may be manually actuated.

The tank 2 may be any vessel capable of holding an electrolyte 1, i.e., liquid solution for plating or etching. The tank 2 is typically composed of a non-conductive material, i.e., insulating material. Examples of materials for the tank 2 include glass, rubber, plastic or Koroseal™. Although, the tank 2 is typically a polymer, embodiments have been contemplated, in which low carbon steel is used for the tank 2.

The electrolyte 1 may be any electrolyte used for electroplating or etch. For copper plating, the electrolyte 1 may be an acidic or alkaline plating bath, a dilute cyanide bath, Rochelle cyanide bath, sodium cyanide bath, potassium cyanide bath, alkaline noncyanide copper plating bath, or pyrophosphate bath or a combination thereof. In the embodiments, in which copper is being plated onto the working electrode 5, the electrolyte 1 may include, but is not limited to, copper cyanide, sodium cyanide, sodium carbonate, sodium hydroxide, Rochelle salt, potassium hydroxide, copper sulfate, sulfuric acid, copper fluoborate and combinations thereof.

In another embodiment, in which chromium is to be plated, the electrolyte 1 may be chromic acid in combination with a catalyst, such as sulfate. In another embodiment, to plate nickel, the electrolyte 1 composition may include at least one of nickel sulfate, nickel sulfamate, nickel chloride, and boric acid. In yet another embodiment, to plate cadmium, the electrolyte 1 composition may be a cyanide bath or a non-cyanide bath. One example of a cyanide bath for plating cadmium includes at least one of cadmium oxide, cadmium metal, sodium cyanide, sodium hydroxide, and sodium carbonate. One example of a non-cyanide bath for plating cadmium includes at least one of ammonium chloride, ammonium fluobarate, ammonium sulfate, boric acid, cadmium, cadmium fluoborate, cadmium oxide, and sulfuric acid.

In a further embodiment, in which zinc is to be plated, the electrolyte 1 composition may be a cyanide zinc bath or an alkaline noncyanide bath. In one example, a cyanide zinc bath is composed of at least one of zinc cyanide, sodium cyanide, sodium hydroxide, sodium carbonate, and sodium polysulfide. In one example, a noncyanide bath for plating nickel includes zinc oxide and sodium hydroxide. In yet another embodiment, the electrolyte 1 may also provide an indium plating. An indium plating may be provided by an indium fluoroborate plating bath composed of indium flouroborate, boric acid and ammonium fluoroborate. In another example, the indium plating may be provided by an indium sulfamate plating bath comprising indium sulfamate, sodium sulfamate, sodium chloride, dextrose and triethanolamine. Indium-lead fluobarate and indium-lead sulfamate plating baths are also possible.

Tin may be deposited from an electrolyte 1 that is composed of alkaline or acid baths. One example of an alkaline bath suitable for a plating electrolyte 1 that provides tin is composed of potassium stannate, sodium stannate, potassium hydroxide and tin metal. One example of an acid bath, i.e., sulfate (acidic) tin plating electrolyte, suitable for a plating electrolyte 1 that provides tin is composed of stannous sulfate, tin metal (as sulfate), free sulfuric acid, phenolsulfonic acid, β-naphthol, and gelatine.

Lead may be deposited from an electrolyte 1 that is composed of fluobarate baths, fluosilicate baths, sulfamate baths and methane sulfonic acid baths. In one example, in which the plating electrolyte 1 is a fluobarate bath, the electrolyte 1 is composed of basic lead carbonate, hydrofluoric acid, boric acid and glue.

Silver may be deposited from an electrolyte 1 that is composed of a cyanide based solution composed of silver (as $KAg(CN)_2$, g/L (oz/gal)), potassium cyanide, and potassium carbonate. Non-cyanide solutions for electroplating silver include those based on simple salts such as nitride, fluobarate, and fluosilicite; inorganic complexes, such as iodide, thiocyanate, thiosulfate, pyrophosphate, and trimetaphosphate; and organic complexes, such as succiniumide, lactate and thiourea.

In another embodiment, the electrolyte 1 may be used to plate, i.e., deposit, gold on the working electrode 5. An electrolyte 1 for depositing gold includes a source of gold, a complexing agent, and a conducting salt to help carry the current. The plating electrolyte for gold may also include an additive for color and hardness. In one example, the plating electrolyte for gold comprises gold as potassium gold cyanide, free potassium cyanide, dipotassium phosphate, sodium hydroxide, sodium carbonate, nickel as potassium nickel cyanide, and silver as potassium silver cyanide.

It is noted that the above-described compositions for the electrolyte 1 are included for illustrative purposes only, and are not intended to limit the disclosure. Other plating/etch electrolytes 1 have also been contemplated and are within the scope of the present disclosure. For example, the electrolyte 1 may also deposit palladium, ruthenium, rhodium, osmium, iridium and platinum. Electrolytes 1 that are suitable for etch processes including oxalic acid, phosphoric acid, sulfuric acid, ammonium persulfate or combinations thereof.

Still referring to FIGS. 1 and 2, in one embodiment, a fluid jet 20 is positioned over the tank 2, and rinses the working electrode 5 when the holder 15 is in the second position, as depicted in FIG. 2. In one embodiment, the fluid jet 20 dilutes the excess electrolyte that is present on the working electrode 5. By dilute it is meant that the concentration of the electrolyte 1 that is present in the liquid on the working electrode 5 after the application of the rinse by the fluid jet 20 is less than the concentration of the electrolyte 1 in the tank 2. The fluid jet 20 does not dry the working electrode 20. The fluid jet 20 may be mounted to the tank 2, such as a sidewall of the tank 2, may be mounted to a stationary component of the holder 15, or may be supported by a structure that is separate from the tank 2 and the holder 15. The fluid jet 20 may be positioned above an upper surface of the electrolyte 1 that is present in the tank 2 by a dimension D1 ranging from 3" to 10". In another embodiment, the fluid jet 20 may be positioned above an upper surface of the electrolyte 1 by a dimension D1 ranging from 4" to 7". In yet another example, the fluid jet 20 may be positioned above an upper surface of the electrolyte 1 by a dimension D1 greater than 4".

The fluid jet 20 may be laterally separated from the plating/etch surface 4 of the working electrode 5 by a dimension D2 ranging from 0.25" to 10" when the holder 15 is in the second position, as depicted in FIG. 2. In another embodiment, the fluid jet 20 may be laterally separated from the plating/etch surface 4 of the working electrode 5 by a dimension D2 ranging from 2" to 5" when the holder 15 is in the second position. In one example, the fluid jet 20 may be laterally separated from the plating/etch surface 4 of the working electrode 5 by a dimension D2 ranging from 0.25" to 2". It is noted that the above dimension are provided for illustrative purposes and are not intended to limit the disclosure, as other embodiments have been contemplated. For example, depending on the pressure, liquid composition, and nozzle size, other dimensions have been contemplated for the positioning of the fluid jet 20, so long as the fluid jet 20 functions in a manner that rinses the working electrode 5.

The fluid jet 20 may have one or more nozzles for delivering a fluid to the working electrode 5. Although, the rinse composition being applied by the fluid jet 20 is typically $H_2O$, such as distilled $H_2O$ or deionized $H_2O$, other rinse compositions are within the scope of the present disclosure. In one embodiment, the rinse composition is selected to provide a liquid medium for removing excess electrolyte that remains on the working electrode 5 after a plating/etch process step, at which time the working electrode 5 has been removed from the electrolyte and the holder 15 is present in the second position, as depicted in FIG. 2. In one embodiment, the rinsing composition can be water, base electrolyte, such as a dilute acid or base, a wetting agent, or a combination thereof. One example includes the application by the fluid jet 20 of a dilute hydrochloric acid solution to the working electrode 5 for rinsing of an alkaline etchant therefrom. The fluid jet 20 may also apply any cleaning solutions, including detergents, to remove the excess electrolyte 1 from the working electrode 5. The fluid jet 20 may apply a fluid at approximately room temperature. In another example, the temperature of the fluid being applied by the fluid jet 20 is less than room temperature, such as 5° C. to 20° C., and in some instances 10° C. to 20° C.

For reel-to-reel applications, the velocity of the rinsing fluid that is provided by the fluid jet 20 may need to be increased to account for the faster movement of the reel, when compared to plating methods in which the material to be plated is not being continually traversed through the plating tank 2 and optional rinsing tanks (not depicted).

Still referring to FIGS. 1 and 2, in one embodiment, a dryer 25 is positioned over the tank 2, wherein when the holder 15 is present in the second position, the dryer 25 blows the liquid including the diluted electrolyte that is present on the working electrode 5 from the fluid jet 20 and the electrolyte 1 into the tank 2. The dryer 25 typically does not dry the working electrode 5, but instead removes a least a portion, e.g., majority, of the liquid including the diluted electrolyte from the working electrode 5 into the tank 2.

The dryer 25 is typically vertically offset from the fluid jet 20. In one embodiment, the dryer 25 is present above the fluid jet 20 by a dimension ranging from 1" to 4". The fluid jet 20 may be positioned above an upper surface of the electrolyte 1 that is present in the tank 2 by a dimension D3 ranging from 5" to 14". In another embodiment, the fluid jet 20 may be positioned above an upper surface of the electrolyte 1 by a dimension D3 ranging from 7" to 10". The fluid jet 20 may be laterally separated from the plating/etch surface 4 of the working electrode 5 by a dimension D4 ranging from 0.25" to 10" when the holder 25 is in the second position, as depicted in FIG. 2. In another embodiment, the fluid jet 20 may be laterally separated from the plating/etch surface 4 of the working electrode 5 by a dimension D2 ranging from 2" to 5" when the holder 15 is in the second position. In one example, the fluid jet 20 may be laterally separated from the plating/etch surface 4 of the working electrode 5 by a dimension D2 ranging from 0.25" to 2" when the holder 15 is in the second position. It is noted that the above dimension are provided for illustrative purposes and are not intended to limit the disclosure, as other embodiments have been contemplated.

The dryer 25 may be a forced air dryer. In some embodiments, the dryer 25 comprises at least one of an axial fan, propeller fan, centrifugal (radial) fans or a cross flow fan. The dryer 25 may also include a heater, and force air having an elevated temperature into contact with the plating/etch surface 4 of the working electrode 5. By "elevated temperature" it is meant that the temperature is greater than the ambient temperature in which the working electrodes is present. The dryer 25 may employ heated air within a range of 25° C. to 100° C. In another embodiment, the temperature may range from 50° C. to 60° C. In another embodiment, the dryer 25 employs air at low temperature. Low temperatures are typically less than room temperature, and may range from 5° C. to 20° C. It is noted that other temperatures for the fluid have been contemplated. In some examples, the fluid may be employed by the fluid jet 20 at less than 5° C. In some examples, the temperatures of the fluid applied by the fluid jet 20 is dictated by the melting temperature of the deposited material, or the melting temperature of the material that remains following etching.

In one embodiment, the dryer 25 is an air knife. In one example, the air knife may include a pressurized air plenum containing at least one hole, or a continuous slot, through which pressurized air exits in a laminar flow pattern. The exit air velocity then creates an impact air velocity onto the surface, i.e., plating/etch surface 4, of the working electrode 5, to which the air is directed. The impact air velocity may be selected to provide a thin layer of liquid that is present on the working electrode 5 after the application of the dryer 25. Typically, it is not desirable to dry the working electrode 5, but to dilute the electrolyte 1 being carrier out of the tank 2 with the working electrode 5 and then remove as much of the diluted liquid including the electrolyte back into the tank 2 (including rinsing tanks where applicable). The working electrode 5, which includes the plated part, may be dried in the final step of the final process. Even then, the working electrode 5 is fully rinsed, except in the cases of Cu-OSP (copper organic surface protectant) or conversion coatings utilized as corrosion prohibitors, which are typically electroless deposition processes.

Although, the examples provided above specify that the dyer 25 employs air, the dryer 25 may employ any gas or mixture of gasses that is suitable for removing the remaining fluid that is present on the working electrode 5 from the fluid jet 20 and the bath of the electrolyte 1. Suitable gasses employed by the dryer 25 include $N_2$, Ar, steam, $CO_2$ and combinations thereof. Because the fluid jet 20 and the dryer 25 are positioned above the tank 2, the excess fluid from the fluid jet 20 and the electrolyte 1 is drained into the bath 2.

Although not depicted in FIGS. 1 and 2, the electroplating/etch apparatus 100 may further include a counter electrode that present in a portion of the electrolyte 1 that is separate from a portion of the electrolyte 1 in which the working electrode 5 is present when the holder 15 is in the first position (as depicted in FIG. 1).

In a plating operation, the counter electrode is an anode and may be composed of a material to replenish the electrolyte 1 during the electroplating process. When forming copper plating, the counter electrode may be composed of copper or iron. The copper may be cast copper, rolled copper, high purity copper, oxygen free copper and phosphorized copper. When forming a nickel plating, the counter electrode may be composed of nickel. The counter electrode for plating cadmium may be composed of a majority of cadmium, i.e., greater than 99% cadmium, alloyed with lead, iron, copper, arsenic and/or zinc. The counter electrode for plating zinc may be composed of a majority of zinc, e.g., 99% zinc, alloyed with lead, cadmium, iron and copper. Counter electrodes for tin deposition are typically composed of tin. Counter electrodes for lead electroplating include lead and iron. Counter electrodes for silver electroplating may be composed of silver or stainless steel.

In an etch operation, the counter electrode is the cathode. Suitable compositions for the counter electrode for etching include SS304, SS316, Ti, Platinized Ti, Ni, Cu, Fe and combinations thereof. The counter electrode may also be composed of Ag, Ni, Al, Zn, Co, Pd, Mo, W, Ru, Rh, Pd, In, Sn, Ta, Ir, Pt, Pb, Bi, Cr, Zr, Nb and combinations and alloys thereof.

The electroplating/etch apparatus 100 may further include a power supply to bias the working electrode 5 and the counter electrode. The power supply may be a direct current (DC) power supply, e.g., a battery, or the power supply may be an alternating current (AC) power supply employed in combination with a rectifier. In the embodiments in which the electroplating/etch apparatus 100 is employed in an electroplating operation, the positive terminal of the power supply is electrically connected to the counter electrode and the negative terminal of the power supply is electrically connected to the working electrode 5. In this example, the counter electrode provides the anode, and the working electrode 5 provides the cathode. In the embodiments in which the electroplating/etch apparatus 100 is employed in an etch operation, the positive terminal of the power supply is electrically connected to the working electrode 5 and the negative terminal of the power supply is electrically connected to the counter electrode. In this example, the counter electrode provides the cathode, and the working electrode 5 provides the anode.

In another aspect, a method of electroplating is provided that utilizes the electroplating/etch apparatus 100 that is depicted in FIGS. 1 and 2. The electroplating method may include providing a tank 2 of an electrolyte 1 including at least one plating metal. An electrode system is provided including an anode, i.e., counter electrode, present within the tank 2 of the electrolyte 1 and a cathode, i.e., working electrode 5, that can be traversed from a first position within the tank 2 containing the electrolyte 1 (as depicted in FIG. 1) to a second position in which the cathode is removed from the tank 2 (as depicted in FIG. 2). The cathode is traversed into the first position and a bias is applied to the anode and the cathode to plate the cathode with at least one plating metal. The cathode is traversed to the second position, and the electrolyte 1 that is present on the cathode is diluted with fluid jet 20, wherein the excess diluted electrolyte drains from the cathode into the tank 2. Following, rinsing of the cathode with the fluid jet 20, at least a portion, e.g., a majority, of the diluted electrolyte is removed from the cathode while in the second position with a dryer 25 to blow at least a portion, e.g., a majority, of the remaining fluid from the fluid jet 20 and the diluted electrolyte from the cathode into the tank 2.

The fluid applied by the fluid jet 20 may be composed of at least one of $H_2O$, boric acid solution, wetting agent, base electrolyte (e.g., sulfamic acid solution) or a combination thereof. Rinsing the cathode with the fluid jet 20 may include a rinsing time period ranging from 5 milli-seconds to 75 milli-seconds. In another embodiment, the rinsing of the cathode with the fluid jet 20 may include a rinsing time period ranging from 10 milli-seconds seconds to 50 milli-seconds.

The dryer 25 removes, e.g., blows, at least a portion of the liquid including the diluted electrolyte from the cathode into the tank 2. The dryer 25 may be an air knife. The dryer 25 may be applied to the cathode for a time period ranging 5 milli-seconds to 75 milli-seconds. In another embodiment, the dryer 25 blows the majority of the liquid including the diluted electrolyte from the cathode into the tank 2 for a time period ranging from 10 milli-seconds seconds to 50 milli-seconds. Typically, it is not desirable to dry the cathode, but to dilute the electrolyte 1 being carrier out with the cathode with the fluid jet 20 and then remove as much of the diluted liquid from the cathode back into the tank 2 (including rinsing tanks where applicable) with the dryer 25.

In another aspect, a method of etching is provided that utilizes the electroplating/etch apparatus 100 that is depicted in FIGS. 1 and 2. In one embodiment, the etching method may include providing a tank 2 of an electrolyte 1. An electrode system is provided including a cathode present within the tank 2 of the electrolyte 1 and an anode, i.e., working electrode 5, that can be traversed from a first position within the tank 2 containing the electrolyte 1 to a second position in which the anode is removed from the tank. The anode is traversed into the first position and a bias is applied to the cathode and the anode to etch the anode. The anode is traversed to the second position, and the anode is rinsed with fluid jet 20 to dilute the electrolyte that is present on the anode. The diluted electrolyte is then forced from the anode into the tank 2 with a dryer 25.

The fluid applied by the fluid jet 20 may be composed of at least one of $H_2O$, boric acid solution, wetting agent, base electrolyte (e.g., sulfamic acid solution) or a combination thereof. The diluting of the electrolyte 1 that is present on the anode with the fluid jet 20 may include a rinsing time period ranging from 5 milli-seconds to 75 milli-seconds. In another embodiment, the diluting of the electrolyte 1 that is present on the anode with the fluid jet 20 may include a rinsing time period ranging from 10 milli-seconds seconds to 50 milli-seconds.

The removal of the majority of the diluted electrolyte from the anode with the dryer 25 may include the application of an air knife as described above. The removal of at least a portion, e.g., a majority, of the diluted electrolyte from the anode with the dryer 25 may include a time period ranging 5 milli-seconds to 75 milli-seconds. In another embodiment, the removal of the majority of the diluted electrolyte from the anode with the dryer 25 may include a time period ranging from 10 milli-seconds seconds to 50 milli-seconds. Typically, it is not desirable to dry the anode, but to dilute the electrolyte 1 being carrier out of the tank 2 with the anode with the fluid jet 20 and then remove as much of the diluted liquid from the anode back into the tank 2 (including rinsing tanks where applicable) with the dryer 25.

When the part being treated is the anode, it can either be etched or anodized. In the case of anodization, the metal is still oxidized. However, instead of the metal entering into the electrolyte it reacts to form a metal oxide on the surface. Sometimes this can be porous or continuous.

The methods and structures disclosed herein reduce drag out of the electrolyte from one tank, e.g., plating tank, to the next tank, e.g., rinse tank, of the plating sequence. In one example, the surfaces to be plated, e.g., work electrode, may have a surface area of 1 meter squared. The methods and structures of the present disclosure reduce drag out so that the amount of liquid including electrolyte, i.e., drag out electrolyte, that is present on the work electrode from one tank to the next tank is less than 50 ml. In one embodiment, the amount of liquid including drag out electrolyte that is present on the working electrode from one tank to the next tank ranges from about 5 ml to about 50 ml. In another embodiment, the amount of liquid including drag out electrolyte that is present on the working electrode from one tank to the next tank ranges from 5 ml to 30 ml. In another embodiment, the amount of drag out liquid on the working electrode from one tank to the next ranges from 10 ml to 30 ml. In yet another embodiment, the amount of liquid including drag out electrolyte on the working electrode from one tank to the next is less than 15 ml.

In some embodiments, the water balance is consistently monitored to ensure that the evaporation rate of the electrolyte is not overwhelmed by the addition of liquid. Some factors that affect water balance include the temperature of the electrolyte, the temperature of the drying gas, and the temperature of the rinsing liquid.

The concepts disclosed herein are applicable to both electrically driven and non-electrically driven plating processes. In some embodiments, the concepts disclosed herein are suitable for the application of corrosion inhibitors, conversion coatings, and chemical etches. In some embodiments, the concepts disclosed herein are applicable for electrolytic etching, chemical etching plating, electropolishing, anodization, conversion coating, corrosion inhibitors and electroless plating.

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What is claimed is:

1. A method of etching comprising:

providing a tank of an electrolyte;

providing an electrode system including a cathode present within the tank of the electrolyte and an anode that can be traversed from a first position within the tank containing the electrolyte to a second position in which the anode is removed from the tank, wherein the anode is mounted to a holder;

traversing the anode and a portion of said holder into the first position and applying a bias to the cathode and the anode to etch the anode;

traversing the anode and said holder into the second position and rinsing the anode with a fluid jet to dilute a remaining portion of electrolyte present on the anode; and removing at least a portion of remaining fluid from the fluid jet and electrolyte that has been diluted from the anode while in the second position with a dryer to blow the portion of the remaining fluid and the electrolyte that has been diluted from the anode into the tank, wherein a liquid including drag out electrolyte is present on the anode in an amount ranging from about 5 ml to about 50 ml.

2. The method of claim 1, wherein the fluid jet applies a fluid comprising $H_2O$, boric acid solution, wetting agent, base electrolyte or a combination thereof.

3. The method of claim 1 wherein the rinsing the anode with the fluid jet comprises a time period ranging from 5 milli-seconds to 75 milli-seconds.

4. The method of claim 1, wherein the dryer comprises at least one of an air knife, axial fan, propeller fan, centrifugal (radial) fans or cross flow fan.

5. The method of claim 1, wherein the removing of the at least the portion of remaining fluid from the fluid jet and the electrolyte that has been diluted from the anode with the dryer comprises a time period ranging from 5 milli-seconds to 75 milli-seconds.

6. The method of claim 1, wherein the holder comprises a non-conductive material.

7. The method of claim 6, wherein the non-conductive material is selected from the group consisting of a polymeric material, a ceramic and glass.

8. The method of claim 1, wherein the fluid jet is mounted to a stationary component of the holder.

9. The method of claim 1, wherein the holder comprises a lip portion having a surface that extends over and in direct contact with the anode.

10. The method of claim 1, wherein the holder comprises a mechanical armature.

11. The method of claim 1, wherein the fluid jet contains one or more nozzles.

12. The method of claim 1, wherein the fluid jet is separate from the tank or holder.

13. The method of claim 1, wherein the anode comprises an electrically conductive material.

14. The method of claim 13, wherein the anode is an elemental metal or an alloy thereof.

15. The method of claim 1, wherein the anode is circular or multi-sided.

* * * * *